343-872 SR
4/12/77 XR 4,017,863

United States Patent [19]
Tharp et al.

[11] 4,017,863
[45] Apr. 12, 1977

[54] HARDENED ELECTROMAGNETIC WAVE ENERGY SENSOR

[75] Inventors: Nelson B. Tharp, Ellicot City, Md.; John W. Henry, Paeonian Springs, Va.; George F. Leydorf, Birmingham, Mich.

[73] Assignee: The United States of America as represented by the Secretary of the Navy, Washington, D.C.

[22] Filed: Mar. 10, 1976

[21] Appl. No.: 665,668

[52] U.S. Cl. ..... 343/719; 343/841; 343/872

[51] Int. Cl.[2] ..... H01Q 1/04

[58] Field of Search ..... 343/719, 841, 842, 872, 343/873

[56] References Cited

UNITED STATES PATENTS

| | | | |
|---|---|---|---|
| 2,532,919 | 12/1950 | Johnson | 343/842 |
| 3,435,457 | 3/1969 | Brueckmann | 343/719 |

*Primary Examiner*—Eli Lieberman
*Attorney, Agent, or Firm*—R. S. Sciascia; L. I. Shrago

[57] ABSTRACT

Hardening of an electromagnetic wave sensor is accomplished by housing it below ground in a protective reinforced concrete structure that supports a cage of insulated conductors that has an interior portion that partially surrounds the sensor so as to shield it from electrical disturbances and an exterior portion that interacts with electromagnetic wave energy present at the ground level and improves the signal couplng to the sensor.

10 Claims, 2 Drawing Figures

HARDENED ELECTROMAGNETIC WAVE ENERGY SENSOR

Figure 2:
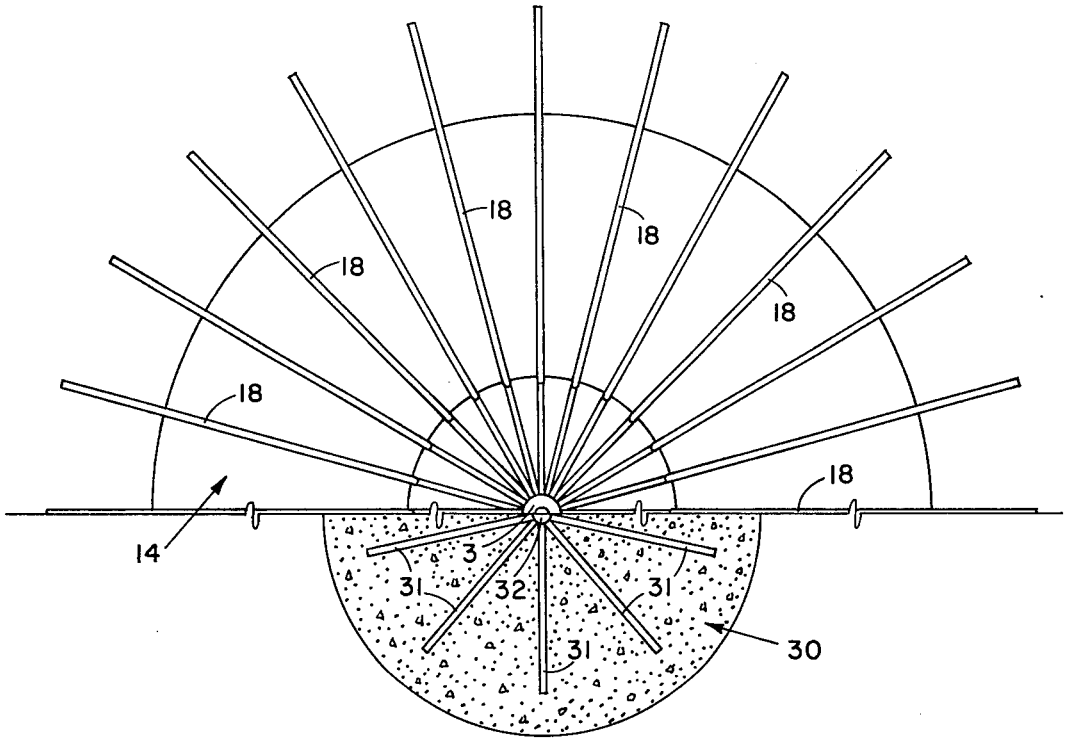

The present invention relates generally to antennas and, more particularly, to a radio receiving antenna arrangement which can withstand severe environment conditions.

In order to survive the extreme temperatures and pressures, ground shock, falling debris and the intense radiation fields which accompany nuclear explosions, the antennas of strategic communication systems are normally "hardened". This procedure usually involves locating the antenna underground surrounded by concrete structures. The protective shielding arrangement must not only safeguard the antenna from destructive forces but, additionally, it must do so without detracting from the operating efficiency of the antenna. For example, the presence of reinforcing ferrous material in the concrete may, under some conditions, give rise to degradation of sensor sensitivity or to reradiated cross-modulation products when these strengthening members are illuminated by a plurality of electromagnetic fields.

It is, accordingly, an object of the present invention to provide a hardened antenna which is highly resistant to the high temperatures and pressures and other destructive environmental effects accompanying nuclear blasts.

Another object of the present invention is to provide a receiving antenna for VLF communication systems which will withstand the heat and blast effects of a nuclear explosion.

Another object of the present invention is to provide a receiving antenna which can survive severe environmental conditions and still exhibit sensitive performance to electromagnetic signal fields.

Briefly, and in general terms, the receiving antenna of the present invention, which takes the form of a multiplicity of turns of an insulated conductor wound concentrically about a suitable core material and designed to detect low frequency electromagnetic signals in the 100 Hz to 150 KHz range, is housed below the surface within a cage of radial conductors associated with a concrete capsule that is embedded within the earth. Each conductor that makes up the cage has a lower segment which extends along a different radius of the capsule's lower end wall, an upstanding vertical segment which continues along an inner wall and an upper horizontal segment which extends over the upper end rim of the capsule outwardly therefrom for a preselected distance. An apron of concrete connected to or forming part of the capsule supports the external upper horizontal segments. All of the conductors are tied together electrically at a single point which corresponds to the center of the bottom end wall of the concrete structure.

The arrangement of radial conductors just described forms a cage whose principal function is to conduct any desired electromagnetic signal currents appearing at the ground surface around the steel reinforcing materials of the hardened capsule into close proximity to the sensor. It, thus, prevents the sensor from being desensitized by the effects of any lossy material such as, iron, wet earth, etc. and any closed metallic loops such as those that may be formed by the reinforcing rods. The concrete capsule which supports the conductors of the cage provides mechanical protection for the antenna and preserves the integrity of the cage against the extremes of temperature and pressure that accompany nuclear explosions.

The top of the concrete structure is closed off by an appropriate cover which serves to provide additional protection from air blasts, falling debris or other types of environmental disturbances. This cover may be cast concrete strengthened by reinforcing rods having low electrical resistance. Alternatively, it may be made of any other suitably hard material which is non-conductive, such as, for example, fiberglass. As regards the reinforcing rods, they should be arranged in a radial configuration so at to present a low electromagnetic loss to any signals that are to be coupled to the sensor.

The protecting cover along with the cage of radial conductors combine to provide an electrostatic shield to the sensor which minimizes electrostatic pick-up and prevents damage to this coil from lightning or any other high potential fields. In the operation of the apparatus, electromagnetic energy propagating in the vicinity of the sensor develops appropriate currents in the horizontal radial conductors which then flow through the cage conductors. As a result of this current flow, corresponding currents are induced in the sensor windings, and these induced currents can be coupled by a suitable radio frequency transmission line to a remote point of utilization where the signal receiving apparatus may be located.

Figure 1:
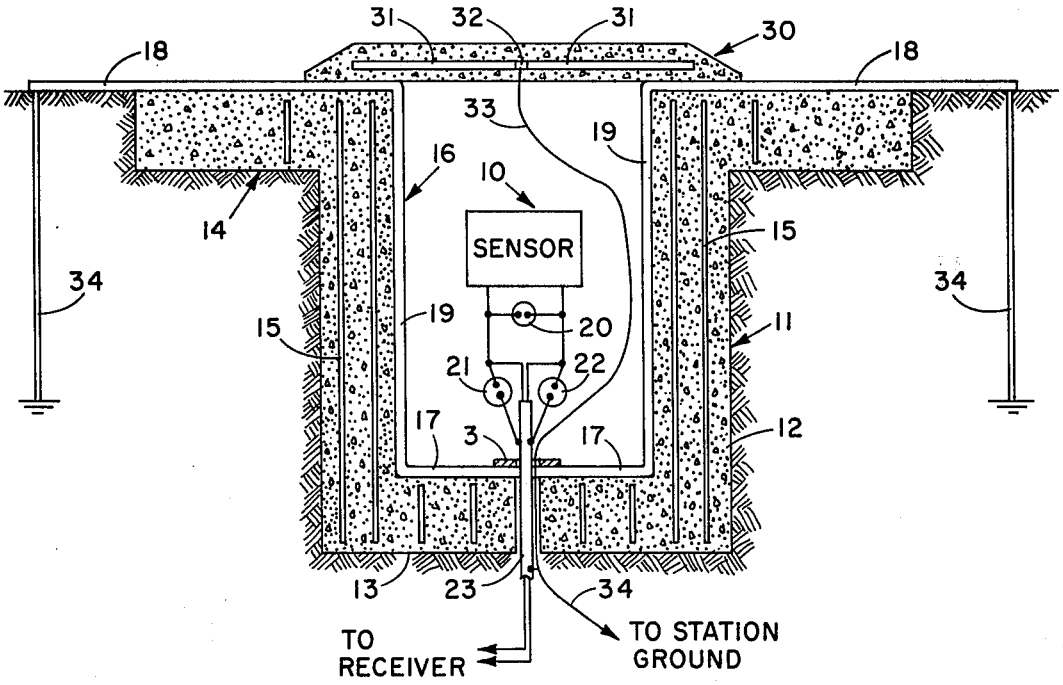

Other objects, advantages and novel features of the invention will become apparent from the following detailed description of the invention when considered in conjunction with the accompanying drawings wherein:

FIG. 1 is a sectional elevation view of a preferred embodiment of the invention; and FIG. 2 is a composite top view of the structure modified to show a section through part of the cover.

Referring now to FIG. 1 of the drawings, the receiving antenna apparatus 10 which is to be protected, in this particular embodiment a magnetic sensor adapted to detect signals in the VLF range, is accommodated below ground level in a reinforced concrete capsule 11 which performs as the "hardening" structure. Antenna 10 may take the form of an appropriate number of turns of an insulated conductor wound concentrically about an air core. Preferably, antenna 10 should be centrally positioned within capsule 11, and it should be spaced from the inside walls of this capsule by at least twice the minimum distance required to prevent the occurrence of any discharge between the antenna and the nearest structure as a result of anticipated lightning or EMP potentials. The supporting means for the antenna, which is not shown, can be of a conventional nature. However, the material used for this purpose should have low conductivity and low di-electric loss at the antenna's operating frequency.

The protective concrete reinforced structure 11 has a hollow cylindrical portion 12, a bottom wall 13, which closes off the lower end of this portion and an upper horizontal apron 14, whose top surface is at or near ground level. Concrete capsule 11 is constructed with a plurality of reinforcing rods, such as 15, which serve to give it sufficient strength to withstand the ground shocks, tremors, accelerations and various other types of disturbances which may appear within the surrounding terrain and propagate in the vicinity of the antenna housing. It would be pointed out in connection with the fabrication of capsule 11 that the various reinforcing rods 15 should not be arranged or otherwise interconnected so as to form conducting loops of any significant size. Such loops tend to degrade the electrical performance of the antenna because of the circulating signal currents which would flow therein. However, if such loops inadvertently do exist, in fact, they can be effectively decoupled from the antenna apparatus by the cage of radials surrounding the sensor.

Under certain conditions, poor electrical connections between the reinforcing rods can give rise to reradiated, intermodulation signal components when these members are illuminated by multi-frequency electromagnetic fields. This phenomenon is sometimes referred to as the "rusty bolt effect". However, this source of noise is also minimized by the cage of radials, as mentioned hereinbefore. The cage is composed of a plurality of radial conductors 16 which, in the modification shown, line substantially the complete interior of the concrete capsule 11 and are supported therefrom by conventional means, not shown. As an alternative construction, these conductors may be embedded directly in the concrete, thus, eliminating the need for any independent supporting means. The individual conductors of the cage are selected so that their diameters are sufficiently small so as to promote coronas or discharges on extremely high electrical fields occurring in their vicinity. Each conductor has a lower horizontal portion 17 which lies along and is co-extensive with the radius of circular end wall 13, a vertical portion 19, which extends upwardly along the inner wall of capsule 11 and an upper horizontal portion 18, which projects over the upper rim of the cylindrical portion 12. Support for the horizontal portions 18 is provided by the concrete apron 14, which is an integral part of capsule 11.

The use of insulated conductors as the cage forming elements is preferred. This prevents any electrical connection from being formed inadvertently between radials at any point other than the common junction point 3. Any such accidental connection, which might be created by water seeping into the antenna well and wetting the concrete, is undesirable since it could create a close metallic loop which would couple to the sensor and act as a shorted turn transformer. This, of course, would reduce the sensor's sensitivity to incoming signals.

As best shown in FIG. 2, the radial conductors 18 extend around the complete circumference of capsule 11. All of their lower horizontal portion 17 are interconnected electrically at a common grounded point 3, which corresponds to the center of bottom wall 13. The number of conductors employed to line the capsule and their spacings, or, from another point of view, the density of these radials, depends upon the nature of the ground within which the concrete capsule is set and the characteristics of the concrete composition. It would be emphasized that the individual conductors 16 must not be connected electrically together except at the one common grounded point 3 above described.

Conductors 16 form what may be termed a conducting cage, and, as mentioned before, it is this cage which provides protection for the sensor 10 against all of the electrical disturbances which may arise from the effects of the reinforcing rods or other lossy materials surrounding the sensor. In this regard, the conducting cage has a low electrical impedance because of the number of individual conductors which make up this enclosure. Also, the current induced in the cage by the electromagnetic signals, which are to be detected, forms a boundary for magnetic fields, and this effectively enhances the magnetic field strength in the area occupied by the magnetic sensor.

The presence of extremely high electrical fields due to lightning, on the other hand, will have the effect of bringing the relatively small diameter conductors of the cage into corona. If this field strength is high enough, it will lead to a stroke, and since the cage provides a short electrical path to ground, a surge of current will take place through the cage to ground. A corresponding surge will occur in the magnetic sensor 10, but this condition is taken care of by surge arrestors 20, 21 and 22 connected across the output terminals of sensor 10 and between these terminals and the shielding of a two-conductor transmission line 23, which links the sensor to the remote receiving apparatus. This shielding is connected to common grounded point 3.

The horizontal portions 18 of the various conductors 16 are made long enough to extend beyond the limits of apron 14. This is done to insure good electrical contact between the remote end portions of these conductors and the surrounding ground. However, grounding of the remote ends of the cage conductors can be further improved by connecting these ends to suitable grounding rods, such as 34, embedded in the terrain a distance sufficient to insure a true ground condition.

Protection against air shock and falling debris is provided by a cover 30 which closes the upper end of the hardened concrete capsule 11. This cover, which, too, may be made of concrete, plastic or any other non-conductive material having adequate strength to withstand the extreme environmental conditions which may occur, accommodates a plurality of radial rods or wires, such as 31, which are embedded therein. The radial configuration is employed because it exhibits a low loss to incoming electromagnetic signals. The radial wires 31 perform as an electrostatic shield, and like the case of the concrete structure, these wires are arranged so that they do not form any closed conducting loops. The common point 32 for all of the radial wires is grounded by a suitable grounding wire 33, which is connected to this point and extends through the interior of the concrete capsule 11 to common ground point 3, which, in turn, is connected by a low impedance conductor 34 to a central station ground. Wire 33 is positioned and arranged so as to have minimum inductive coupling to sensor 10. Additionally, it is laid out so that it does not contain any sharp bends or any other types of discontinuities which may act to introduce unwanted impedance to any high transient currents which may flow therein when the high electrical fields produce current surges in the sheild. An alternate arrangement is to connect the central point 32 to one only radial wire 16 and so achieve an electrostatic ground.

It would be mentioned that the gaps between the ends of shield wire 31 and the confronting portions of the radial ground conductors 18 are made intentionally small so that any high potential generated in the cover shield can discharge across these gaps.

It would also be mentioned that the horizontal radials rather than resting on the concrete apron could be embedded in this concrete structure. This arrangement would give mechanical protection to this part of the cage against surface blast effects. Additionally, it would safeguard these lengths from close contact with low resistance earth, debris or other lossy materials which might tend to provide a shorting conductive path between the radials and cause a close loop coupling effect to occur near the sensor.

What is claimed is:

1. Apparatus for hardening an electromagnetic wave energy sensor comprising, in combination a concrete housing embedded in the ground and adapted to accommodate said sensor at a below ground location, said housing being constructed with an opening which is located at ground level;

a cage formed by a plurality of conductors supported by said housing and partially surrounding said sensor, each conductor of said cage having a horizontal length portion which extends outside of said housing whereby electromagnetic wave energy appearing in the vicinity of said housing produces a current flow in said cage that provides signal coupling to said sensor; and a protective cover closing the opening of said housing.

2. In an arrangement as defined in claim 1 wherein a portion of said cage which is within said housing has a configuration that generally conforms to the inner shape of said housing.

3. In an arrangement as defined in claim 1 wherein each of said conductors is insulated and wherein the remote ends of said horizontal length portions are connected to ground and the other corresponding ends of each conductor are interconnected and also grounded.

4. In an arrangement as defined in claim 1 wherein said protective cover is constructed of a material which exhibits a low impedance to electromagnetic wave energy propagation.

5. In an arrangement as defined in claim 4 a plurality of conductors embedded in said protective cover and arranged in a radial pattern; and means for interconnecting and grounding the inner confronting ends of said last-mentioned conductors.

6. Apparatus for protecting an electromagnetic wave sensor against physical and electrical distrubances occurring within its vicinity comprising, in combination a cylindrical reinforced concrete housing embedded in the ground and adapted to accommodate said sensor, said housing being closed off at its lower end with a bottom wall and having a circular apron which extends outwardly from its upper end, the upper surface of said apron being substantially at ground level;

a plurality of conductors lining the interior of said housing and being supported therefrom, each conductor having a lower horizontal portion which corresponds to a different radius of the bottom wall of said housing, a vertical portion which extends upwardly the length of said housing and an upper horizontal portion which extends along the upper surface of said apron and terminates a given distance therebeyond, said conductors being insulated from each other and being interconnected only at a single location that corresponds to the center of said bottom wall;

means for grounding the remote terminating ends of said upper horizontal portions and said single location whereby electromagnetic wave energy impinging on said upper horizontal portions produces a corresponding current flow within said conductors that provides signal coupling to said sensor; and a protective cover closing the upper end of said concrete housing.

7. In an arrangement as defined in claim 6 a plurality of conductors embedded in said protective cover in a radial pattern; and means for grounding the inner confronting ends of said last-mentioned conductors.

8. Apparatus for hardening an electromagnetic wave energy sensor so as to protect it from environmental disturbances which occur in its vicinity comprising, in combination a hollow cylinder made of reinforced concrete embedded in the ground with its upper end located at ground level, said cylinder being closed off at its lower end with a bottom wall;

a concrete apron integrally formed with said cylinder and extending completely around the upper end thereof, the top surface of said apron being located substantially at ground level;

a cage made of a multiplicity of radially arranged conductors positioned within said cylinder, said conductors having horizontal length portions which extend outside of said cylinder and lie along a plurality of different directions, said horizontal length portions interacting with any electromagnetic signals present at ground level and causing corresponding currents to flow in said cage; and means for grounding the remote ends of said horizontal length portions and a central bottom point of said cage.

9. In an arrangement as defined in claim 8 a protective cover closing the upper end of said hollow cylinder and made of a material which presents a low impedance to electromagnetic wave energy propagation.

10. In an arrangement as defined in claim 9 a plurality of conductors embedded in said protective cover and arranged in a radial pattern, said last-mentioned conductors having their confronting ends interconnected and grounded.

* * * * *